US005787322A

United States Patent [19]

Sass et al.

[11] Patent Number: 5,787,322

[45] Date of Patent: Jul. 28, 1998

[54] MULTIFUNCTION CUSTOMER REPLACEABLE UNIT LATCH

[75] Inventors: Douglas W. Sass, Ontario; Alvin J. Owens, Jr., Fairport; David E. Rollins, Lyons, all of N.Y.

[73] Assignee: Xerox Corporation, Stamford, Conn.

[21] Appl. No.: 832,716

[22] Filed: Apr. 11, 1997

[51] Int. Cl.[6] ..... G03G 15/00; G03G 21/00

[52] U.S. Cl. ..... 399/110; 399/123

[58] Field of Search ..... 399/110–123

[56] References Cited

U.S. PATENT DOCUMENTS

| | | | |
|---|---|---|---|
| 4,174,172 | 11/1979 | Lane | 399/348 |
| 4,460,267 | 7/1984 | Ogawa | 399/119 |
| 4,866,483 | 9/1989 | Davis et al. | 399/123 |
| 4,888,620 | 12/1989 | Fujino et al. | 399/110 |
| 4,891,676 | 1/1990 | Davis et al. | 399/121 |
| 5,105,228 | 4/1992 | Kato | 399/122 |
| 5,126,799 | 6/1992 | Matsuura et al. | 399/110 |
| 5,208,639 | 5/1993 | Thayer et al. | 399/351 |
| 5,237,377 | 8/1993 | Harada et al. | 399/354 |
| 5,386,282 | 1/1995 | Palmer et al. | 399/345 |
| 5,396,320 | 3/1995 | Lange | 399/350 |
| 5,442,422 | 8/1995 | Owens, Jr. et al. | 399/103 |
| 5,587,769 | 12/1996 | Sawada et al. | 399/113 |

*Primary Examiner*—Arthur T. Grimley
*Assistant Examiner*—Sophia S. Chen
*Attorney, Agent, or Firm*—John S. Wagley

[57] ABSTRACT

A mechanism for selectively positioning a plurality of components in a printing machine is provided. The mechanism includes a lever for controlling the mechanism, a first linkage operably connecting the lever to a first component, and a second linkage operably connecting the lever to a second component, so as to simultaneously reposition the first component and the second component by actuating the lever.

19 Claims, 6 Drawing Sheets

MULTIFUNCTION CUSTOMER REPLACEABLE UNIT LATCH

Figure 1:
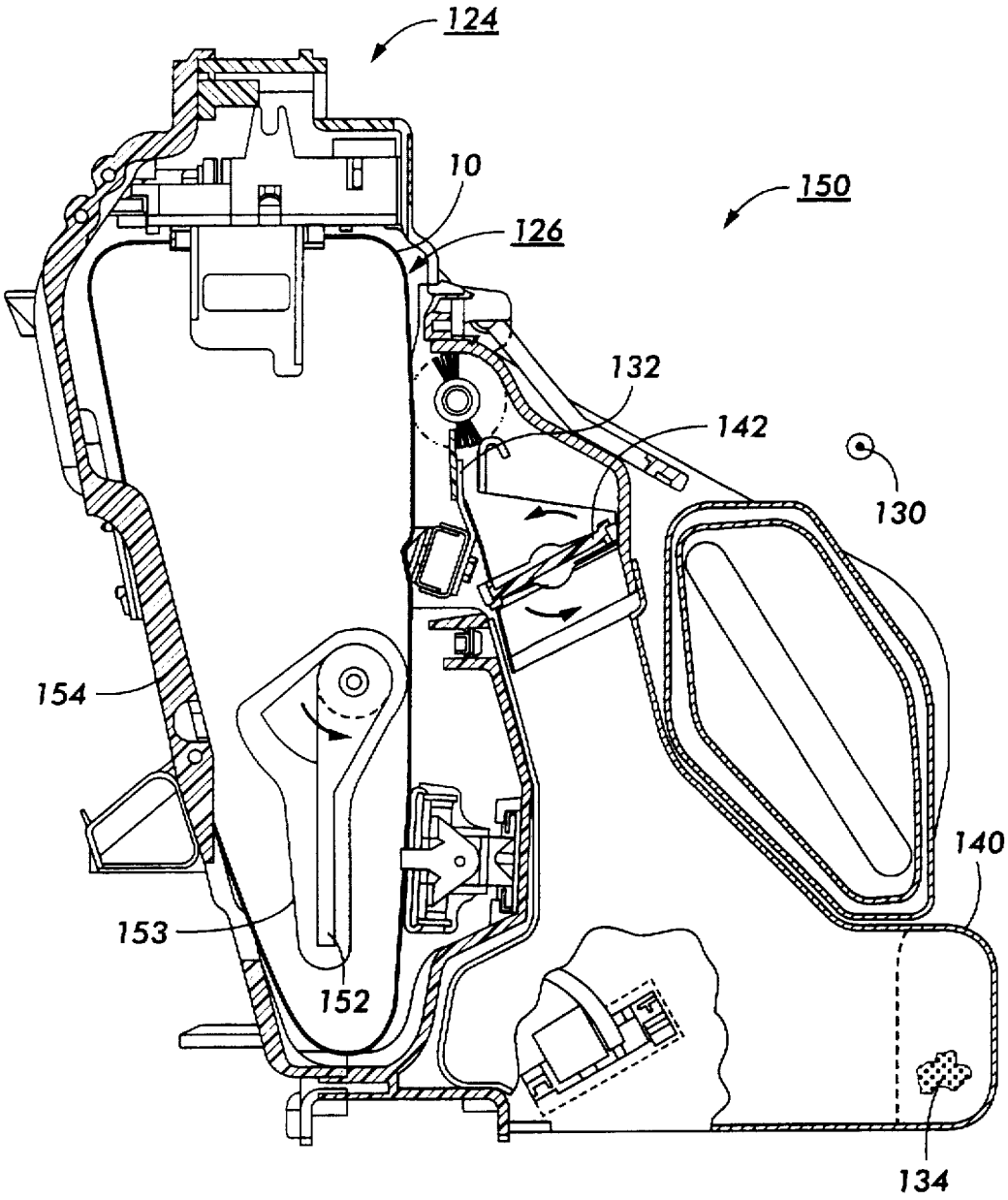

This invention relates generally to a customer replaceable unit (CRU) for a printing machine, and more particularly concerns a xerographic module for an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, a CRU is a customer replaceable unit which can be replaced by a customer at the end of life or at the premature failure of one or more of the xerographic components. The CRU concept integrates various subsystems whose useful lives are predetermined to be generally the same length. The service replacement interval of the CRU insures maximum reliability and greatly minimizes unscheduled maintenance service calls. Utilization of such a strategy, allows customers to participate in the maintenance and service of their copiers/printers. CRUs insure maximum up time of copiers and minimize downtime and service cost due to end of life or premature failures.

It is desirable to have a CRU that enables a variety of machine subsystems to be incorporated into a single unit while maximizing the useful life of each component. It is further desirable to utilize a CRU that allows service to a machine to be performed efficiently and at a relatively low cost and in some cases to be serviced by the user himself. It is a further benefit to have the ability to reuse and recycle various CRU components in today's climate of environmental awareness.

It is important that customer replaceable units be customer friendly. In other words, it is important that the CRUs may be easily removed and reinstalled with minimal instructions and minimal training. Unfortunately, the CRUs typically include a number of items that are critical to the proper operation of the machine, e.g. charging devices, photoreceptors and developer subsystems. These components and subsystems are very delicate and need to be properly handled and to not be damaged during the installation and removal of the CRUs. CRUs, particularly xerographic CRUs, typically include toner, e.g. waste toner or new toner. Access must be had between a waste toner reclaim bottle and the cleaning portion of the xerographic CRU. During removal and transportation of a CRU, it is important that the toner stored within a toner supply source or a toner waste bottle be properly secured. Waste toner bottles as well as new toner bottles typically include seals and/or covers to prevent the inadvertent spilling of toner into the CRU. The customer must properly position such seals or doors during CRU installation and removal.

The cleaning or removal of excess toner from the photoconductive member in a printing machine is typically handled by a cleaning blade. The photoconductive member is typically very delicate and may easily be damaged by the cleaning blade. CRUs that must be separated from a photoconductor during assembly and removal require that the cleaning blade be moved in a position away from the CRU prior to removal of the CRU. The critical alignment and positioning of components within a CRU for the respectively removal and installation of the CRU make the CRU installation and removal process difficult for an untrained customer.

The present invention is directed to alleviate at least some of the aforementioned problems.

The following disclosures may relate to various aspects of the present invention.

U.S. Pat. No. 4,174,172

Patentee: Lane

Issue Date: Nov. 13, 1979

U.S. Pat. No. 4,866,483

Patentee: Davis et al.

Issue Date: Sep. 12, 1989

U.S. Pat. No. 4,891,676

Patentee: Davis et al.

Issue Date: Jan. 2, 1990

U.S. Pat. No. 5,208,639

Patentee: Thayer et al.

Issue Date: May 4, 1993

U.S. Pat. No. 5,237,377

Patentee: Harada et al.

Issue Date: Aug. 17, 1993

U.S. Pat. No. 5,386,282

Patentee: Palmer et al.

Issue Date: Jan. 31, 1995

U.S. Pat. No. 5,396,320

Patentee: Lange

Issue Date: Mar. 7, 1995

U.S. Pat. No. 5,442,422

Patentee: Owens, Jr. et al.

Issue Date: Aug. 15, 1995

Some portions of the foregoing disclosures may be briefly summarized as follows:

U.S. Pat. No. 4,174,172 discloses a method and apparatus for cleaning a surface. The surface is moved in one direction relative to a cleaning blade in engagement therewith. Rest periods are provided of no relative motion wherein the blade is moved out of contact with the surface at a first position during the period of no relative motion.

U.S. Pat. No. 4,866,483 discloses an improved cleaning station for use in a print engine having cleaning elements. The photoreceptor belt cleaning station is positioned in front of the print engine and the photoreceptor medium is positioned in the other frame of the print engine so that the cleaning station is directly accessible when the print engine is open.

U.S. Pat. No. 4,891,676 discloses an improved cleaning station for use in a print engine having cleaning elements. The transfer medium cleaning station is equipped with a locking mechanism that allows inserting the cleaning station and removing it from the print engine without scraping the transfer medium with the cleaning element.

U.S. Pat. No. 5,208,639 discloses an apparatus for cleaning residual toner that includes a multiple turret style blade holder located such that an individual blade is selectively indexed into optimum position.

U.S. Pat. No. 5,237,377 discloses a cleaning device for a dry printing device which includes a cleaning brush brought into resilient contact with a photosensitive drum. A rotational direction switching mechanism switches the rotation of the brush.

U.S. Pat. No. 5,386,282 discloses an apparatus for retraction and engaging the cleaning blade from the imaging surface and preventing copy reprint. At least one of the two momentary switches are depressed by one of at least two lobes on a motorized cam.

U.S. Pat. No. 5,396,320 discloses an electrostatic printer having a cleaning blade for removing residual particles from the surface of a photoconductive substrate. A mechanism automatically retracts the cleaning blade away from the substrate to avoid scraping the blade against a seam on the substrate.

U.S. Pat. No. 5,442,422 discloses an apparatus for cleaning the imagining surface of a printer. The contamination seal captures all accumulated toner from the blade edge and in the brush nip due to gravity.

In accordance with one aspect of the present invention, there is provided a mechanism for selectively positioning a plurality of components in a printing machine. The mechanism includes a lever for controlling the mechanism, a first linkage operably connecting the lever to a first component, and a second linkage operably connecting the lever to a second component, so as to simultaneously reposition the first component and the second component by actuating the lever.

Pursuant to another aspect of the present invention, there is provided a customer replaceable unit for use in a printing machine. The customer replaceable unit includes a body for mounting a first component and a second component. The customer replaceable unit further includes a mechanism for selectively positioning of the components. The mechanism includes a lever for controlling the mechanism, a first linkage operably connecting the lever to the first component, and a second linkage operably connecting the lever to the second component, so as to simultaneously reposition the first component and the second component by actuating the lever.

Pursuant to yet another aspect of the present invention, there is provided an electrophotographic printing machine of the type including a customer replaceable unit. The customer replaceable unit includes a body for mounting a first component and a second component. The customer replaceable unit further includes a mechanism for selectively positioning of the components. The mechanism includes a lever for controlling the mechanism, a first linkage operably connecting the lever to the first component, and a second linkage operably connecting the lever to the second component, so as to simultaneously reposition the first component and the second component by actuating the lever.

Figure 2:
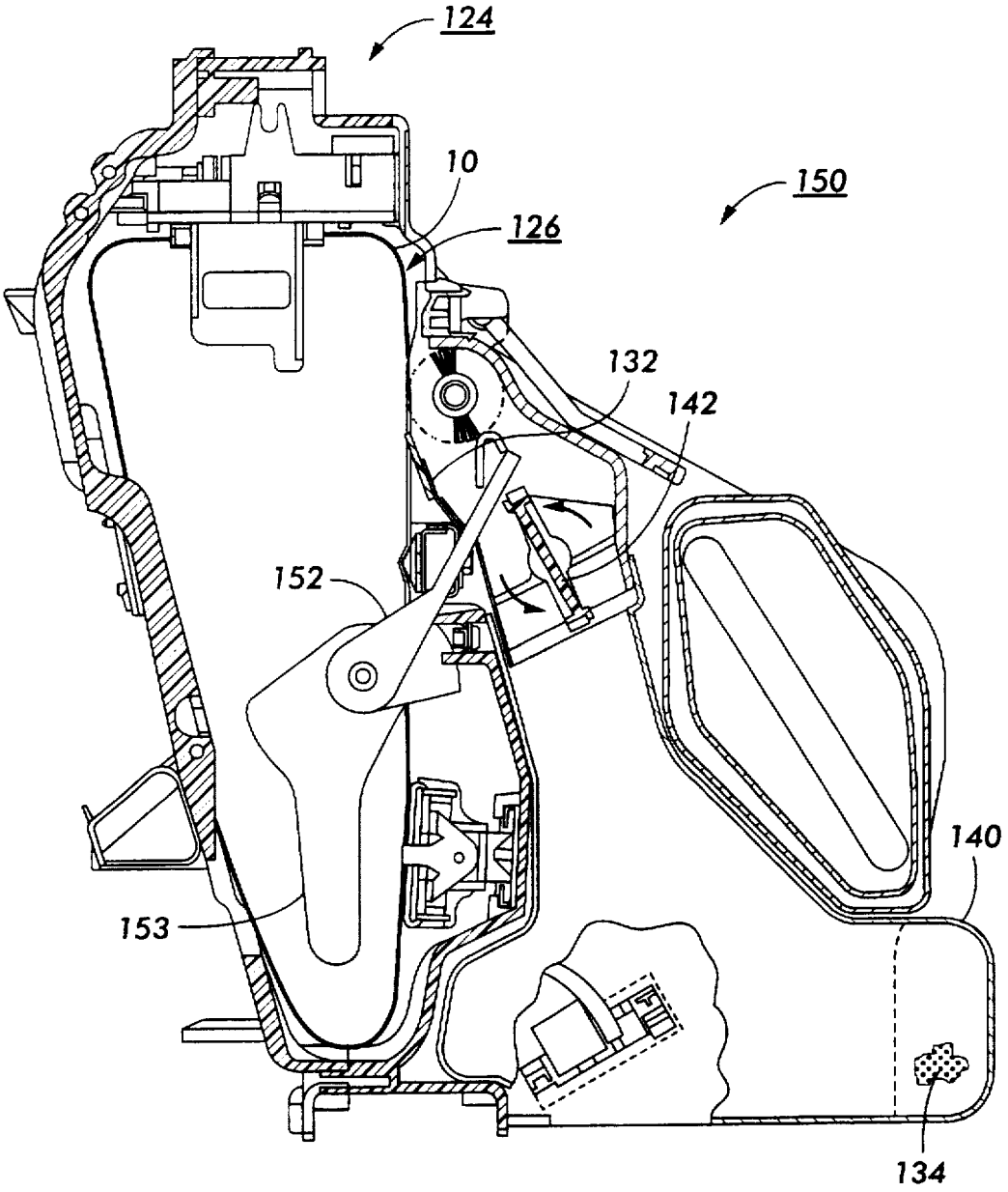
Figure 3:
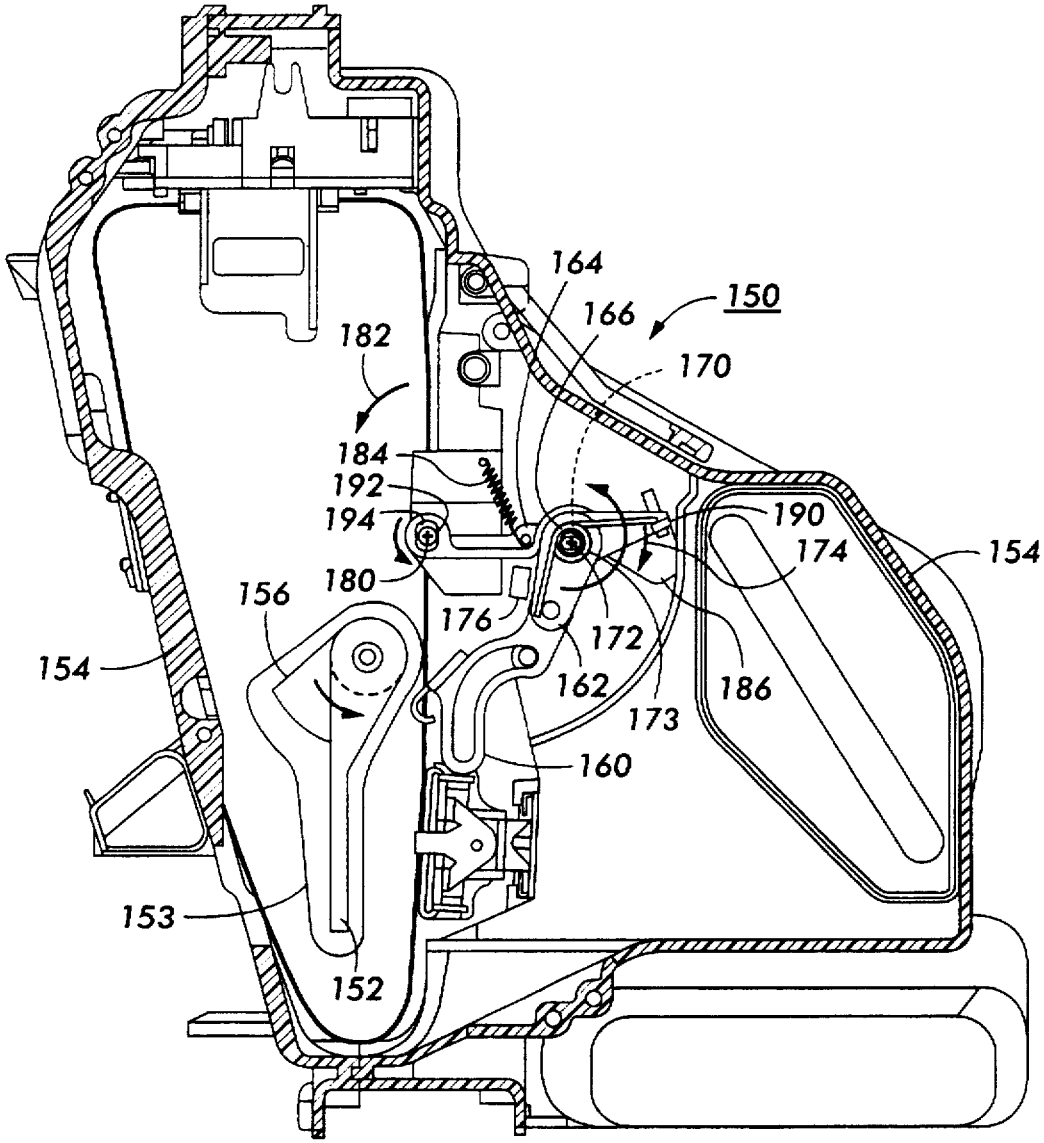
Figure 4:
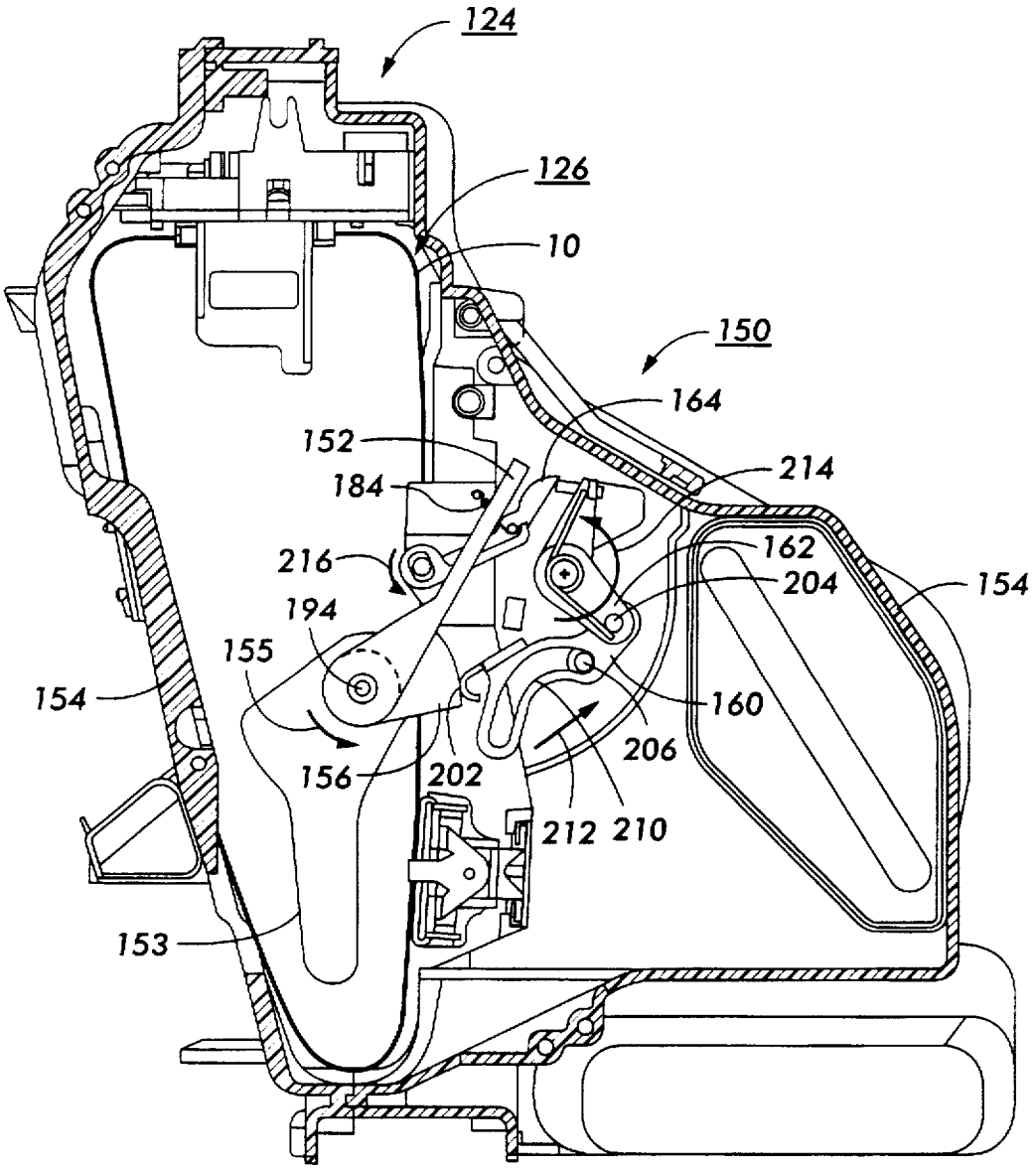
Figure 5:
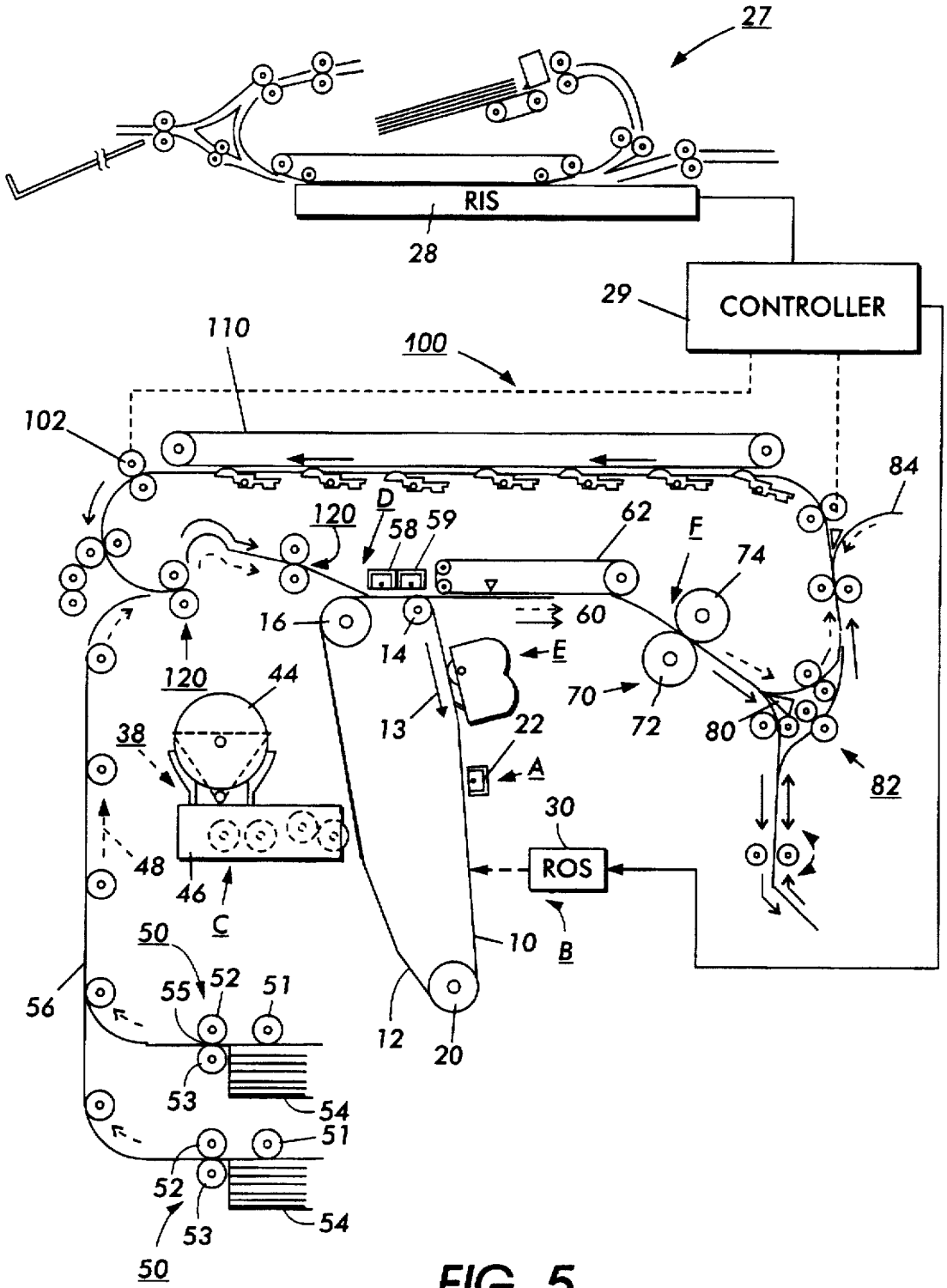
Figure 6:
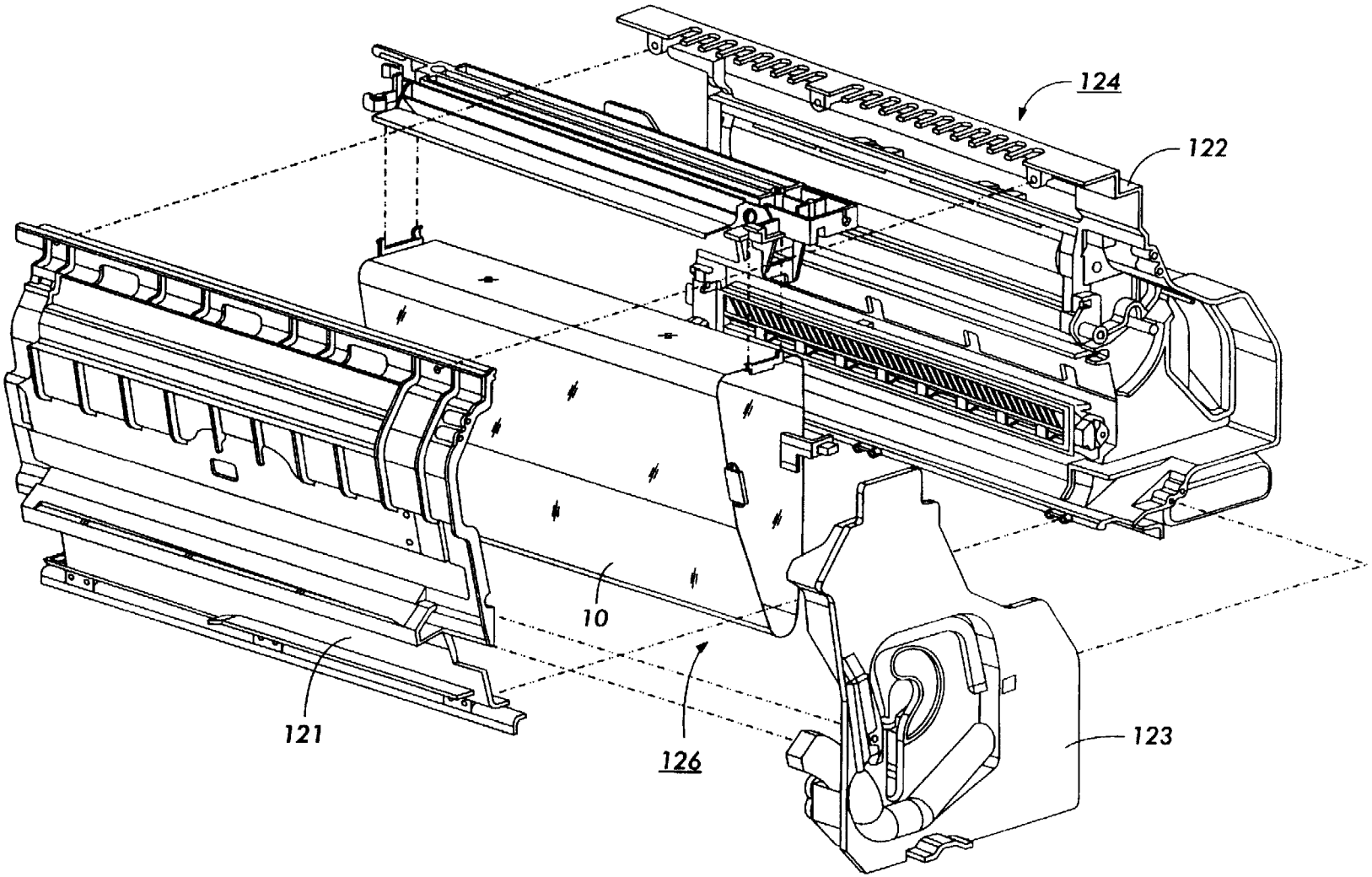

Other features of the present invention will become apparent as the following description proceeds and upon reference to the drawings, in which:

FIG. 1 is an elevational view partially in cross section of a customer replaceable unit for use in the FIG. 5 printing machine showing the latch of the present invention in the unlatched position FIG. 2 is a is an elevational view partially in cross section of a customer replaceable unit for use in the FIG. 5 printing machine showing the latch of the present invention in the latched position FIG. 3 is a is an elevational view partially in cross section of a customer replaceable unit for use in the FIG. 5 printing machine showing the linkage in greater detail and showing the latch in the unlatched position FIG. 4 is a is an elevational view partially in cross section of a customer replaceable unit for use in the FIG. 5 printing machine showing the linkage in greater detail and showing the latch in the latched position FIG. 5 is a schematic elevational view of a typical electrophotographic printing machine utilizing the multifunction customer replaceable unit latch of the present invention; and FIG. 6 is a perspective view of a customer replaceable unit for use in the printing machine of FIG. 1.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements. FIG. 5 schematically depicts an electrophotographic printing machine incorporating the features of the present invention therein. It will become evident from the following discussion that the multifunction latch of the present invention may be employed in a wide variety of devices and is not specifically limited in its application to the particular embodiment depicted herein.

Referring to FIG. 5 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 5 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 5, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 of the invention herein, described in detail below, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Turning next to FIG. 6, there is illustrated a perspective view of xerographic CRU 124. The xerographic CRU module mounts and locates xerographic subsystems in relationship to the photoreceptor module and xerographic subsystem interfaces. Components contained within the xerographic CRU include the transfer/detack corona generating devices, the pretransfer paper baffles, the photoreceptor cleaner, the charge scorotron, the erase lamp, the photoreceptor (photoreceptor) belt, the noise, ozone, heat and dirt (NOHAD) handling manifolds and filter, the waste bottle, the drawer connector, CRUM, customer replacement user monitor; the automatic cleaner blade engagement/retraction and automatic waste door open/close device.

A summary of the xerographic CRU components and the function of each is as follows:

Cleaner (Doctor blade and Disturber Brush): remove untransferred toner from the photoreceptor; transport waste toner and other debris to a waste bottle for storage; assist in controlling the buildup of paper talc, filming and comets on the photoreceptor belt.

Precharge Erase Lamp: provides front irradiation of the photoreceptor to the erase the electrostatic field on the surface Charge Pin Scorotron: provides a uniform charge level to the photoreceptor belt in preparation for imaging.

Photoreceptor Belt: charge retentive surface advances the latent image portions of the belt sequentially through various xerographic processing stations which converts electrostatic field on the surface Pretransfer Paper Baffles: directs and controls tangency point between the paper and photoreceptor surface. Creates an "S" bend in paper to flatten sheet in the transfer zone.

Transfer Wire Corotron: places a charge on the paper as in passes under the corotron. The high positive charge on the paper causes the negative charged toner to transfer from the photoreceptor to the paper.

Detack Pin Corotron: assist in removing paper with its image from the photoreceptor by neutralizing electrostatic fields which may hold a sheet of paper to photoreceptor. Sheet self strips as it passes over a stripper roll on belt module.

NOHAD Dirt Manifolds and Filter: removes airborne toner dirt and contaminates from the moving air before it leaves the CRU. The captured toner and contaminates are deposited in a dirt filter contained in the xerographic CRU.

Electrical Drawer Connector: provides connector interface for the CRUM; provides input/output for machine control.

CRUM Chip: allows machine to send reorder message (user interface or automatically) for CRU or other; method to monitor number of copies purchased by the customer and warrantee the CRU for premature CRU failures; provides handshake feature with machine to ensure correct CRU installed in compatible machine; shuts down machine at the appropriate CRU kill point; enables market differentiation; enables CRU life cycle planning for remanufacture; enables remote diagnostics; provides safety interlock for the ROS.

ROS and Developer Interface: provides a developer interface window to allow transfer of toner for imaging from developer donor roll to photoreceptor belt surface latent image; Also, provides critical parameter mounting and location link which ties ROS to photoreceptor module to ensure proper imaging and eliminate motion quality issues.

BTAC, black toner area coverage, Sensor Interface: provides interface window to monitor process controls.

Registration Transport Interface: provides outboard critical parameter location and mounting feature.

Prefuser Transport Interface: provides critical parameter location and mounting feature.

The CRU subsystems are contained within the xerographic housing. The housing consist of three main components which include the front end cap 123, right side housing 122 and left side housing 121. The xerographic housing is a mechanical and electrical link. It establishes critical parameters by mounting and locating subsystems internal and external to the CRU in relationship to the photoreceptor module and other xerographic subsystem interfaces. The housing allows easy reliable install and removal of the xerographic system with out damage or difficulty.

The front end cap joins the right and left side housings together on the outboard end of the CRU. The front end cap also functions as a mechanical link with features which mount and locate on the outboard of the machine the photoreceptor module, ROS and registration transport in relationship to one another in order to achieve mechanical critical parameters. The end cap also mounts spring loaded slide, waste door pivot and blade pivot links which allows the customer to simultaneously engage and disengage the cleaner waste door and blade during install and removal of the CRU when the photoreceptor module handle is rotated. When removed from the machine, the blade pivot link insures the cleaner blade remains retracted to prevent photoreceptor belt and blade damage during CRU install and removal. The waste door pivot link secures the cleaner waste bottle door closed when the CRU is removal to prevent spillage of toner during shipping. The end cap also mounts a dirt manifold which links the left side housing developer manifold with the NOHAD dirt filter in the right side housing. The manifolds transport airborne toner and other contaminates to the dirt filter by means of an airflow stream.

The right side housing mounts and locates a number of the xerographic subsystems and interfaces internal and external to the CRU. The right side housing mounts one half of the transfer and detack assembly, charge scorotron, photoreceptor belt and drawer connector. These components are allow to float within the CRU housing. They achieve critical parameter locations with the photoreceptor module and machine frame when the CRU housing is fully installed and the photoreceptor module handle engages the tension roll. Both the charge scorotron and transfer/detack subsystem are located by means of spring loads located on the photoreceptor module.

The right side housing also contains molded scorotron retention features and mounts and locates a charge spring which retracts the charge scorotron subsystem to the housing when the CRU is removed from the machine. The spring enables successful install and removal of the CRU without damage to the charge scorotron.

The right side housing has molded ports in the charge scorotron mounting area to allow non-contaminated air to flow over the charge device in order to remove any contaminates which would affect the performance of the unit. i.e. (nitrous oxide a cause of parking deletions).

The right side housing features molded vents at the transfer/detack location. The vents also allow sufficient air over the transfer and detack devices to prevent any nitrous oxide contamination.

The housing has special molded features which mount and locate the cleaner assembly, precharge erase lamp, waste bottle and NOHAD air duct and filter. The right housing mounts and locates the interfaces of the cleaner blade and waste door pivot features. The housing positions the NOHAD air duct and filter to the blower to allow sufficient airflow to capture airborne contaminates and toner.

The photoreceptor belt 10 is partially retained by molded fingers with are located on the inboard and outboard areas of the right housing. Other retaining belt fingers are located on the transfer detack housing and left side housing. The housing has a molded feature at the lower outboard end which positions the belt on the photoreceptor module 126 to prevent belt damage.

The left side housing serves as protective cover for the photoreceptor belt and provide interface windows with various subsystems surrounding the CRU. The interface windows include the BTAC, developer and ROS. The housing also mounts one half of the transfer detack subsystem. It also provides an interface window with the registration transport for the entry of paper. The developer dirt manifold is also mounted and located on the left side housing. Two of the belt retaining fingers and a molded feature at the lower outboard end retain and position the photoreceptor belt during install and removal. The left side housing has a molded baffle which covers ROS on outboard end to prevent customer exposure to the ROS beam.

The integrated CRU housing ramps the registration transport and prefuser transport into position when the unit is installed in the machine. The CRU housing makes 22 critical mechanical and electrical interfaces almost simultaneously. All the housings possess double bosses which allows the unit to be secured together during the manufacturing build. If both bosses happen to strip out over time, a longer screw can be used to secure the parts due to sufficiently deep bosses.

According to the present invention and referring to FIG. 1, a xerographic CRU 124 is shown. The xerographic CRU 124 surrounds photoreceptor module 126. The CRU 124 is installed and removed from the printing machine by motion in the direction of arrow 130 normal to the view as shown in FIG. 1. Cleaning blade 132 is preferably used to remove waste toner 134 from the photoreceptor belt 10 of the photoreceptor module 126. Since the CRU 124 is removed from the photoreceptor module 126 by moving the CRU 124 outwardly in the direction of arrow 130, the cleaner blade 132 tends to scratch and damage the photoreceptor 10. Thus, as shown in FIG. 1, the cleaner blade 132 is placed in a retracted position as shown in FIG. 1 separated from the photoreceptor 10.

The waste toner 134 is collected from the cleaner blade 132 in a waste toner bottle 140. The waste toner bottle 140 includes a bottle door 142 which as one should appreciate, must be in an open position during the cleaning of the photoreceptor 136. Preferably, the waste toner bottle 140 utilizes the bottle door 142 in a closed position to prevent the waste toner 134 to migrate past the bottle door during shipment of the CRU. One should appreciate that the bottle door 142 and the cleaner blade 132 must both be moved from a first position to a second position prior to removal of the CRU 124 from the printing machine. A multi-function CRU latching mechanism 150 is utilized according to the present invention to simplify and assist in the installation and removal of the CRU 124.

While as shown and later described, the multi-function CRU latching mechanism 150 is utilized to simultaneously open and close the bottle door 142 and the cleaner blade 132, it should be appreciated that a multi-function CRU latching mechanism may be utilized to simultaneously move any of a number of components within a CRU to ease the assembly and disassembly of a CRU. Likewise, it should be appreciated that the multifunction CRU latching mechanism 150 may be equally applicable to the removal of other components that may be removed from the printing machine, e.g. access panels or paper trays.

The multi-function CRU latching mechanism 150 includes an actuator, for example, in the form of latching handle 152. The latch handle 152 may be mounted to the CRU 124 or as shown in FIGS. 1–4, the latch handle 152 may be secured to the printing machine and remain within the printing machine when the CRU 124 is removed. An opening 153 surrounding the lathe handle in the unlatched position permits the removal of the CRU 124 while permitting latching handle 152 to remain within the machine. The cleaner blade 132 and the bottle door 142 are preferably secured to housing 154 of the CRU. The housing 154 may be made of any suitable, durable material but preferably is made of a plastic which has low cost and may be easily recycled. For example, the housing 154 may be made of polystyrene.

While it should be appreciated that a variety of linkages may be utilized to simultaneously actuate the bottle door 142 and the cleaning blade 132, applicants have found that a particular linkage was well suited for the CRU 124 as shown in FIGS. 1–4.

Referring now to FIG. 2, the CRU 124 is shown with the cleaner blade 132 in contact with the photoreceptor 136 and with the bottle door 142 in the open position. The CRU 124 as shown in FIG. 2 is in an operating mode where the cleaning blade may remove the waste toner 134 and the waste toner may pass by the bottle door 142 into the waste toner bottle 140. One can see at this position that the latching handle 152 is in a second upward position. Since opening 153 in the CRU 124 is no longer in alignment with the latching handle 152, the CRU when in the operating mode cannot be removed from the printing machine.

Referring now to FIG. 3, the multi-function CRU latching mechanism 150 is shown in greater detail. The CRU in FIG. 3 is shown in the unlocked or shipping position corresponding to FIG. 1. The mechanism 150 is operated by latch handle 152. As can be readily seen in FIG. 3, the latch handle 152 is spaced from and not in contact with the remainder of the mechanism 150. Thus, in this position, the bottle door 142 is closed and the cleaner blade 132 is retracted from the photoreceptor 10 (see FIG. 1).

Referring again to FIG. 3, the mechanism 150 includes four basic components: the handle 152 which includes a cam 156 preferably intrically molded therewith, a follower link 160, which as shown in FIG. 3 is not in contact with the handle in the unlatched position, a door link 162 fittedly secured to the follower link 160, and a cleaner blade link 164 operably connected to the door link 162. The basic components of the latching mechanism 150, the handle 152, follower link 160, door link 162 and cleaner blade link 164 may be made of any suitable durable material. For example, these components may be made of metal or a durable plastic. For example, the follower link 160 may be made from sheet metal while the handle 152 and links 162 and 164 are preferably molded of a high strength plastic for example, glass filled polycarbonate. The bottle door 142 (see FIG. 1) preferably includes journals or stems 166 which extend from the outer ends of the door 142. The journal 166 includes features, e.g. driving flats which mate with the driving slot 170 of the door link 162. Thus, as the door link 162 rotates about centerline 172, the bottle door 142 likewise rotates in a similar direction. Preferably, a device 173, e.g. a torsion spring, is used to bias the door link 162 in the direction of arrow 174 against stop 176.

The cleaning blade link pivots about centerline 180 and is urged in the direction of rotation 182 by a coil spring 184. The cleaning blade link 165 is restrained by the contact between surface 186 of link 164 and surface 190 of door link 162. In the position of the latching mechanism 150 as shown in FIG. 3, the cleaner blade 132 which is rotatably connected with the cleaning blade link 164 by flats 192 on the cleaning blade mating with flats 194 on the cleaning blade link 164.

Referring now to FIG. 4, the CRU 124 is shown with the multi-function CRU latching mechanism 150 in the locked position. The mechanism 150 is locked by rotating the handle 152 in the direction of arrow 155. A stop (not shown) on the housing 154 may be used to limit the motion of the handle 152 in the direction of arrow 155. As the handle 152 rotates, cam 156 is rotated in position with follower 202 of follower link 160. The follower link 160 is rotatably secured to door link 162 by pin 204. The follower link 162 is further constrained by a follower pin 206 which is fixedly secured to the housing 154. The follower link 162 is permitted to move relative to the follower pin 206 along slot 210. The follower pin 206 thus moves in the general direction of arrow 212. As the follower link 160 rotates in the direction of arrow 214, the rotation of follower link 160 urges the door link 162 to rotate in the direction of arrow 214 and surface 190 of door link 162 contacts surface 186 of cleaner blade link 164 (see FIG. 3) causing cleaner link 164 to rotate in the direction of arrow 216. As link 164 rotates in the direction of arrow 216, the cleaner blade 132 (see FIG. 1) rotates in the direction of arrow 216 to a point of contact with the photoreceptor 10.

It should be appreciated that the invention may be practiced with a multi-function latching mechanism substantially different from that as shown in the latching mechanism 150 of FIGS. 1–4. For example, the linkage may be made entirely of cams or gears or belts or pulleys or a combination of such mechanisms in addition to any mechanically translating and rotating device.

By providing a multi-function latching machine for a printing machine, multiple functions can be accommodated by a single latching motion.

By providing a multi-function latching mechanism according to the present invention, a simpler more trouble-free installation of a CRU may be provided.

By providing a multi-function latching mechanism on a removable portion of a copy machine, the removing of the mechanism may be eased and simplified.

By providing a multi-function CRU latching mechanism damage to the internal components of the printing machine may be minimized by automatically avoiding contact between components that may cause damage.

While the invention herein has been described in the context of black and white photoreceptor CRU, it will be readily apparent that the device can be utilized in electrophotographic printing machine in which ease of service and customer service ability is desired.

It is, therefore, apparent that there has been provided in accordance with the present invention, a CRU module that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A mechanism for selectively positioning a plurality of devices in a printing machine, comprising:

a manually actuated lever for controlling the mechanism;

a first linkage operably connecting said lever to a first device for performing a first function; and a second linkage operably connecting said lever to a second device for performing a second function, the first function being independent of the second function, so as to simultaneously reposition the first device and the second device by manually actuating said lever.

2. A mechanism according to claim 1, wherein a portion of said first linkage and said second linkage are integral with each other.

3. A mechanism according to claim 1, wherein said lever comprises a cam.

4. A mechanism for selectively positioning a plurality of components in a printing machine, comprising:

a lever for controlling the mechanism;

a first linkage operably connecting said lever to a first component; and a second linkage operably connecting said lever to a second component, so as to simultaneously reposition the first component and the second component by actuating said lever, a portion of said first linkage and said second linkage being integral with each other, wherein said first linkage operably connects said lever to a toner waste door and wherein said second linkage operable connects said lever to a cleaning blade.

5. A mechanism according to claim 4, wherein:

said first linkage includes a first link connected to said lever, a second link connected to said first link and to the toner waste door; and said second link includes said first link connected to said lever, said second link connected to said first link, and a third link connected to said second link and to the cleaning blade.

6. A mechanism for selectively positioning a plurality of components in a printing machine, comprising:

a lever for controlling the mechanism;

a first linkage operably connecting said lever to a first component; and a second linkage operably connecting said lever to a second component, so as to simultaneously reposition the first component and the second component by actuating said lever, at least one of said first and said second linkages including a link having a slot for cooperating with a fixed pin secured to the printing machine.

7. A customer replaceable unit for use in a printing machine comprising:

a slidably mounted body for mounting a first device for performing a first function and a second device for performing a second function, the first function being independent of the second function, the customer replaceable unit being removably slidably mounted to the machine; and a mechanism for selectively positioning of the devices, the mechanism including a lever for controlling the mechanism, a first linkage operably connecting said lever to the first device, and a second linkage operably connecting said lever to the second device, so as to simultaneously reposition the first device and the second device by actuating said lever.

8. A customer replaceable unit according to claim 7, wherein a portion of said first linkage and said second linkage are integral with each other.

9. A customer replaceable unit according to claim 7, wherein said lever comprises a cam.

10. A customer replaceable unit for use in a printing machine comprising:

a body for mounting a first component and a second component; and a mechanism for selectively positioning of the components, the mechanism including a lever for controlling the mechanism, a first linkage operably connecting said lever to the first component, and a second linkage operably connecting said lever to the second component, so as to simultaneously reposition the first component and the second component by actuating said lever, a portion of said first linkage and said second linkage are integral with each other, said first linkage operably connecting said lever to a toner waste door said second linkage operable connecting said lever to a cleaning blade.

11. A customer replaceable unit according to claim 10, wherein said:

said first linkage includes a first link connected to said lever, a second link connected to said first link and to the toner waste door; and said second link includes said first link connected to said lever, said second link connected to said first link, and a third link connected to said second link and to the cleaning blade.

12. A customer replaceable unit for use in a printing machine comprising:

a body for mounting a first component and a second component; and a mechanism for selectively positioning of the components, the mechanism including a lever for controlling the mechanism, a first linkage operably connecting said lever to the first component, and a second linkage operably connecting said lever to the second component, so as to simultaneously reposition the first component and the second component by actuating said lever, at least one of said first and said second linkages including a link having a slot for cooperating with a fixed pin secured to the printing machine.

13. An electrophotographic printing machine of the type including a customer replaceable unit comprising:

a slidably mounted body for mounting a first device for performing a first function and a second device for performing a second function, the first function being independent of the second function, the customer replaceable unit being removably slidably mounted to the machine; and a mechanism for selectively positioning of the devices, the mechanism including a lever for controlling the mechanism, a first linkage operably connecting said lever to the first device, and a second linkage operably connecting said lever to the second device, so as to simultaneously reposition the first device and the second device by actuating said lever.

14. A printing machine according to claim 13, wherein said lever is rotatable.

15. A printing machine according to claim 13, wherein a portion of said first linkage and said second linkage are integral with each other.

16. A printing machine according to claim 13, wherein said lever comprises a cam.

17. An electrophotographic printing machine of the type including a customer replaceable unit comprising:

a body for mounting a first component and a second component; and a mechanism for selectively positioning of the components, the mechanism including a lever for controlling the mechanism, a first linkage operably connecting said lever to the first component, and a second linkage operably connecting said lever to the second component, so as to simultaneously reposition the first component and the second component by actuating said lever, a portion of said first linkage and said second linkage are integral with each other, said first linkage operably connecting said lever to a toner waste door, said second linkage operable connecting said lever to a cleaning blade.

18. A printing machine according to claim 17, wherein said:

said first linkage includes a first link connected to said lever, a second link connected to said first link and to the toner waste door; and said second link includes said first link connected to said lever, said second link connected to said first link, and a third link connected to said second link and to the cleaning blade.

19. A customer replaceable unit for use in a printing machine comprising:

a body for mounting a first component and a second component; and a mechanism for selectively positioning of the components, the mechanism including a lever for controlling the mechanism, a first linkage operably connecting said lever to the first component, and a second linkage operably connecting said lever to the second component, so as to simultaneously reposition the first component and the second component by actuating said lever, at least one of said first and said second linkages including a link having a slot for cooperating with a fixed pin secured to the printing machine.

* * * * *